United States Patent [19]

Sakamoto

[11] Patent Number: 4,986,750

[45] Date of Patent: Jan. 22, 1991

[54] FURNACE

[75] Inventor: Hidasato Sakamoto, Chiba, Japan

[73] Assignee: Furnace Juko Kabushiki Kaisha, Saitama, Japan

[21] Appl. No.: 358,076

[22] Filed: May 30, 1989

[30] Foreign Application Priority Data

May 31, 1988 [JP] Japan ..... 63-134244
Jul. 29, 1988 [JP] Japan ..... 63-190346

[51] Int. Cl.[5] ..... F27B 9/02
[52] U.S. Cl. ..... 432/131; 432/139
[58] Field of Search ..... 432/124, 131, 139, 199, 432/171; 414/156, 172, 180; 198/478.1, 468.6

[56] References Cited

U.S. PATENT DOCUMENTS 939,880 11/1909 Wedge ..... 432/171
1,836,002 12/1931 Balz ..... 432/139
1,979,312 11/1934 Burns ..... 432/131
2,013,975 9/1935 Thomas ..... 432/131
4,702,694 10/1987 Johnson et al. ..... 432/139

FOREIGN PATENT DOCUMENTS 288013 10/1915 Fed. Rep. of Germany ..... 432/131
61-544 1/1986 Japan .
62-48152 10/1987 Japan .
380929 7/1973 U.S.S.R. ..... 432/124

*Primary Examiner*—Henry A. Bennet
*Assistant Examiner*—Denise L. F. Gromada
*Attorney, Agent, or Firm*—Kanesaka and Takeuchi

[57] ABSTRACT

Disclosed is a furnace in which the inside of the furnace is enclosed by a furnace wall having an inner surface lined with a heat insulating material. Heaters for heating an inside of the upper furnace chamber to a predetermined temperature, and an upper turntable supported so as to be rotatable horizontally and arranged to mount works on an upper surface thereof are provided in the upper furnace chamber. Other heaters for heating the inside of a lower furnace chamber to a predetermined temperature, and a lower turntable supported so as to be rotatable horizontally independently of the upper turntable and arranged to mount works on an upper surface thereof are provided in the lower furnace chamber. Delivery of a work from/to the outside of the furnace to/from each of the upper and lower turntables is performed by insertion of a fork through an opening formed in a predetermined position of the furnace wall. In this structure, for example, carburizing treatment on a work is carried out in the upper furnace chamber and diffusion treatment on a work is carried out in the lower furnace chamber.

13 Claims, 3 Drawing Sheets

FURNACE

BACKGROUND OF THE INVENTION

1. Field of the Invention

The present invention generally relates to a furnace for performing heating and/or heat treatment of a work, and particularly relates to a furnace provided with a plurality of vertically-disposed furnace chambers each having at least one disc-like turntable, the turntables of the respective furnace chambers being disposed coaxially, the furnace chambers being made different in temperature from each other.

2. Description of the Prior Art

In the process of producing a work such as a gear, a shaft, a piston pin, a crank shaft, or the like from steel products, for example, Ni—Cr steel, Ni—Cr—Mo steel, Cr steel, Cr—Mo steel, or the like, the steel products are subject to heat treatment to strengthen the metal structure thereof after worked through forging. Examples of the heat treatment includes carburizing. In the process of carburizing, even if a CO gas suitable for performing carburizing is generated, the carburizing phenomenon cannot be generated if the steel product forming a work is ready to receive carbon. That is, steel does not have capability of receiving carbon before the steel has become $\gamma$ iron which can exist only at a temperature not lower than the $A_1$ transformation temperature of about 723°C. In order to perform carburizing, therefore, it is necessary to heat steel to a temperature not lower than 723°C. Steel exists in the state of $\alpha$ iron at a temperature lower than 723°C., and the capability of performing carburizing of such an $\alpha$ iron is extremely small. Accordingly, the carburizing temperature is generally set to a value within a range of from 880°C. to 930°C. Namely the carburizing temperature is selected to be higher than the above range, so that a deep carburized layer can be obtained in short time. This is because carbon atoms which have entered the steel easily enter the inside of the steel, and this phenomenon is called diffusion. A carburized work is further heated to a suitable quenching temperature, for example, within a range of from 800°C. to 850°C., and then cooled rapidly in oil so as to be hardened.

The foregoing carburizing and diffusion has been performed by a process in which a furnace system having horizontally arranged several furnaces or batch furnaces is prepared and a tray or a basket in which a plurality of work is held is passed through the batch furnaces from the inlet of the system to the outlet of the same so that the works are subject to carburizing, diffusion, and quenching and then taken out from the outlet of the system. Since a plurality of works is held in a tray, a basket, or the like, the heat to be applied to the works held at the center portion of the bottom of the tray or the like is reduced because it is absorbed by the works held at an upper portion or near the outer periphery of the tray or the like, while the heat applied to the latter works is proper. Accordingly, an agitating fan has been provided to make the furnace temperature even. It is however difficult to make the furnace temperature even only by providing a fan, and therefore a plurality of heating means is additionally provided. Further, thermal distortion is caused not only in works but in jigs or the like supporting the works, because also such jigs or the like are heated to the carburizing temperature and the diffusion temperature. Further, cooling distortion is also caused in the jigs or the like in cooling operation. It is therefore impossible to use the jigs or the like for a long time and the jigs or the like are regarded as consumption goods. Furthermore, when the atmospheric temperature in the furnaces is controlled in performing heat treatment on the work, it is necessary to take the heat capacity of the trays, baskets, or jigs or the like into consideration. However, the heat capacity of a jig or the like per se is generally larger than that of a work and therefore the quantity of heat required for heating is increased so that uneconomical operation is obliged to be carried out.

The inventor of this application has proposed a furnace in which a plurality of turntables is vertically arranged in the inside of a cylindrical furnace chamber having a vertical axial line, works are mounted on the turntables, and the turntables are horizontally rotated to make the works subject to heat treatment, as disclosed in Japanese Patent Post-examination Publication No. 61-544 published on Jan. 9, 1986 (filed on Aug. 27, 1982, and granted as Japanese Pat. No. 1,339,640) and in Japanese Patent Post-examination Publication No. 62-48152 published on Oct. 12, 1987 (filed on Oct. 11, 1984, and granted as Japanese Pat. No. 1,441,721). More specifically, the furnace is provided with a cylindrical furnace chamber oriented so that its axis is directed in the vertical direction. A plurality of turntables is coaxially disposed so as to be horizontally rotatable and a plurality of work mounts for holding works thereon is provided at suitable intervals on an outer circumference of an upper surface of each of the turntables. In the central portion of the turntables, a circulating fan which rotates at a speed higher than that of the turntables is provided so as to make the temperature in the furnace uniform and diffuser blades are concentrically radially provided so as to be in opposition to the circulating fan. Further, a work insertion hole and a work take-out hole are provided in side portions of a furnace wall so that works can be mounted on the work mounts through the work insertion hole by means of a fork and works after treated can be taken out of the take-out hole by using the fork. In this, the furnace can be made relatively compact as a whole, and a large number of works can be successively continuously subject to heat treatment. Further, the heating air current from heating means is diffused by the diffuser blades through the relative rotation between the turntables and the circulating fan, so that heat transmission of works can be rapidly performed.

SUMMARY OF THE INVENTION

It is an object of the present invention to provide a furnace in which the advantages of the above-mentioned furnace are sufficiently shown, and in which at least two furnace chambers thermally isolated from each other are provided so that individual temperature control can be performed in the furnace chambers separately from each other, whereby heating and heat treatment can be performed in a single furnace which is relatively compact.

It is another object of the present invention to provide a furnace in which individual temperature control can be performed in the furnace chambers separately from each other and so as to make the temperature distribution uniform in each furnace chamber, and in which a small quantity of heat suffices the furnace operation.

When the furnace is used, for example, as a heat-treatment furnace, works can be heat treated in a manner as follows. That is, works to be heat-treated are put into the furnace through an opening and mounted on a first turntable in a first furnace chamber so as to be subject to heat treatment at a first thermal atmospheric temperature. Then, the works are moved to a second turntable in a second furnace chamber by a work transporting means so as to be subject to heat treatment at a second thermal atmospheric temperature. In this case, since the first and second furnace chambers are isolated from each other by means of a partition, the quantity of heat applied to the first and second furnace chambers by the heater means can be controlled separately from each other. Further, since only works are mounted on the turntable, the control of the atmospheric temperature in each furnace chamber can be performed taking into consideration only the heat capacity of the works, after the atmospheric temperature in the furnace chamber has become steady.

According to the present invention, only works are mounted on the first and second turntables in the respective first and second furnace chambers so as to be subject to heat treatment, and therefore it is not necessary to use consumption goods such as jigs or the like so that the furnace operation cost can be reduced. Further, it is not necessary to heat jigs together with works to be heat-treated and only the works are heated. Accordingly, the temperature rising time is shortened, so that the heat treatment can be performed more efficiently.

Further, in the furnace according to the present invention, since only works are heat-treated, the heat capacity of to be treated is small, the atmospheric temperature control can be performed easily, and accuracy of the heat treatment including quenching can be improved. Moreover, since the heat treatment can be performed immediately after machining or forging, the steps before and after the working such as forging or the like can be directly connected to each other to thereby make it possible to promote factory automatization. Furthermore, since the furnace can be formed into a substantially cylindrical shape, the installation area of the furnace can be reduced in comparison with the conventional batch furnace or continuous furnace. Also, only works per se can be treated, and the volume of the furnace chambers per se can be made small. Further, the quantity of heat required for heating can be reduced and the atmospheric temperature in the upper and lower furnace chambers can be precisely controlled separately from each other through the partition therebetween, so that the time required for lowering the temperature from the carburizing one to the diffusion one or to the quenching one can be shortened and the operation cost of the furnace can be reduced.

These and other objects, features, and advantages of the present invention will be apparent from the following detailed description of the preferred embodiments with reference to the accompanying drawings.

DETAILED DESCRIPTION OF THE PREFERRED EMBODIMENTS

Now, referring to the accompanying drawings, description will be made in detail as to two embodiments of the furnace according to the present invention in the case where the furnace if used as a heat-treatment furnace. In the two, first and second, embodiments, items which are the same as or correspond to each other are correspondingly referenced, and duplicated explanation is omitted.

Figure 1:
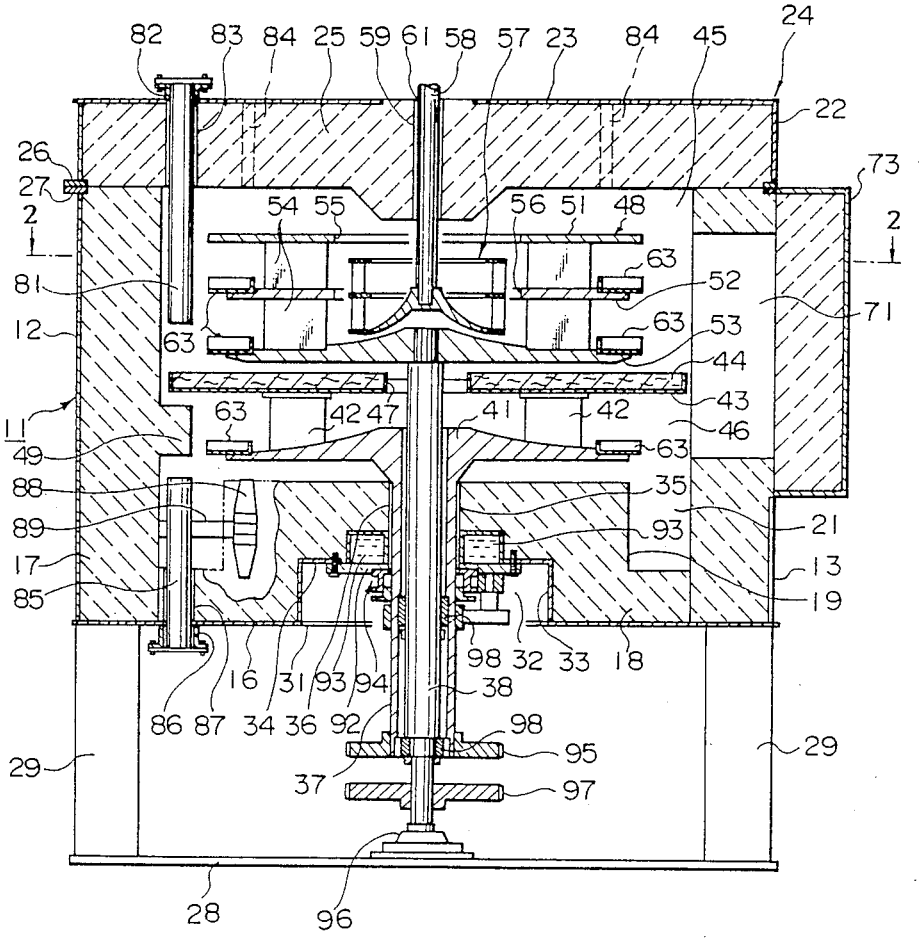
FIG. 1 is a longitudinal sectional side view showing a first embodiment of the furnace according to the present invention, in longitudinal section along line 1—1 of FIG. 2.

First, referring to FIGS. 1 and 2, the first embodiment of the present invention will be described. A furnace 11 has outer walls constituted by left and right walls 12 and 13, front and rear walls 14 and 15 each connecting the left and right walls 12 and 13 to each other, and a bottom wall 16 covering the bottom of a portion surrounded by the left and right walls 12 and 13 and the front and rear walls 14 and 15. Those outer walls are formed of heat-resistant steel plates. An inner circumferential wall 17 made of a heat insulating material such as ceramic wool or the like is attached on the inner surface of the surrounding walls consisting of the left and right walls 12 and 13 and the front and rear walls 14 and 15 so as to form a cylindrical inner circumferential surface thereon. A cylindrical inner bottom wall 18 made of the same heat insulating material as that of the inner circumferential wall 17 is attached an upper surface of the bottom wall 16 so that the outer circumferential surface of the inner bottom wall 18 is fitted into the inner circumferential wall 17. An upper outer circumferential surface 19 of the inner bottom wall 18 is formed to have an outer diameter smaller than that of a lower portion of the inner bottom wall 18 so as to form a gap 21 between the upper outer circumferential surface 19 and the inner circumferential wall 17. A cap 24 constituted by an outer circumferential wall 22 and an upper wall 23 covering the upper portion of the outer circumferential wall 22 is attached on the upper end of the portion surrounded by the left and right walls 12 and 13 and the front and rear walls 14 and 15, the outer circumferential wall 22 having the same shape as that of the outer circumferential walls constituted by the walls 12, 13, 14, and 15. An inner upper wall 25 made of the same heat insulating material as that of the inner circumferential wall 17 is mounted inside the cap 24. The outer circumferential wall 22 is formed of the same heat-resistant steel plate as that of the upper wall 23. The outer circumferential wall 22 is provided with a flange 26 at its lower end, the flange 26 being projected outwards so as to contact with a flange 27 formed, in the same manner as the flange 26, on the upper ends of the left and right walls 12 and 13 and on the upper ends of the front and rear walls 14 and 15. The flanges 26 and 27 are firmly fixed to each other by bolts and nuts (both not shown) provided at suitable intervals.

The bottom wall 16 is attached on the upper ends of a plurality of supports 29 which are fixed at their lower ends at suitable intervals onto a base 28, so that the furnace 11 is provided on the base 28 with a gap therebetween.

A round opening 31 is formed though the central portion of the bottom wall 16, and a recess 32 having an inner diameter substantially equal to the diameter of the opening 31 is formed in the lower central portion of the inner bottom wall 18. A cylindrical member 33 of a heat-resistant steel plate is attached on the inner circumferential surface of the recess 32. An upper plate 34 having an opening at its central portion is attached to the upper end opening portion of the cylindrical member 33. A through hole 35 is formed through the inner bottom wall 18 at the central portion of the recess 32 so as to reach the upper surface of the inner bottom wall 18. A rotary shaft of the double shaft structure constituted by a hollow outer shaft 37 and an inner shaft 38 inserted into the outer shaft 37, is inserted in the through hole 35 through a sleeve 36.

The upper end of the outer shaft 37 is projected from the upper surface of the inner bottom wall 18, and a disc-like lower turntable 41 is provided integrally on the upper end edge of the outer shaft 37. The outer diameter of the lower turntable 41 is selected so as to be smaller than the inner diameter of the cylindrical portion constituted by the inner circumferential wall 17. A plurality of supporting plates 42 is vertically attached on the lower turntable 41 at suitable circumferential intervals in a manner so that the planes of the respective supporting plates 42 extend substantially in the radial directions of the lower turntable 41. A doughnut like shielding plate 43 is attached or mounted on the upper ends of the supporting plates 42. The shielding plate 43 is formed of a heat-resistant steel plate. A plate-like heat insulating material 44 having the same quality of material as that of the inner circumferential wall 17 is attached on the upper surface of the shielding plate 43. The shielding plate 43 has an outer diameter larger than that of the lower turntable 41, and disposed so as to have a fine gap between the shielding plate 43 and the wall surface of the inner circumferential wall 17. Further, the shielding plate 43 is disposed so as to vertically divide the inside of the furnace 11 into two portions at a ratio of 2 to 1. That is, the shielding plate 43 serves as a boundary portion between the thus formed upper and lower furnace chambers 45 and 46. An annular protrusion 49 formed integrally with the inner circumferential wall 17 is disposed in the vicinity of the lower surface of the outer circumferential portion of the shielding plate 43.

The upper end of the inner shaft 38 extends so as to be projected upward from the upper end of the outer shaft 37 and further extends so as to be projected from the upper end of the shielding plate 43 through a central opening 47 of the shielding plate 43. An upper turntable 48 is attached on the upper end edge of the inner shaft 38. The upper turntable 48 has a doughnut-like first upper turntable 51, a second upper turntable 52 having the same shape as that of the first upper turntable 51, and a third upper turntable 53 fixed at its central portion on the inner shaft 38. Between the first and second upper turntables 51 and 52, and between the second and third upper turntables 52 and 53, a plurality of supporting plates 54 similar to the supporting plates 42 is provided at circumferential suitable intervals, so that the first, second, third upper turntables 51, 52, and 53 are vertically disposed at vertically designated intervals by means of the supporting plates 54. A silocco fan 57 for sucking air from the central portion of the furnace 11 and for sending the air to the outer circumferential portion of the same is inserted into central openings 55 and 56 of the first and second upper turntables 51 and 52 so as to send the wind to the second and third upper turntables 52 and 53. The upper end of a rotary shaft 58 which is fixed at its lower end to the central portion of the silocco fan 57 extends upward through a sleeve 61 inserted into a through hole 59 vertically formed through the central portion of the inner upper wall 25. The rotary shaft 58 and the inner shaft 38 are coaxially disposed. A plurality of blade members 62 is provided circumferentially in the gap between the supporting plates 54 attached between the first and second turntables 51 and 52 and between the second and third turntables 52 and 53 so that the blade members 62 act as a diffuser for causing an air current from the silocco fan 57 to radially uniformly flow as shown in FIG. 1. Alternatively, the arrangement may be made such that each of the supporting plates 54 is constituted by the blade member 62 and the upper ends of all the blade members 62 or selected ones of the blade members 62 with predetermined circumferential intervals are fixed on the lower surface of each of the first and second turntables 51 and 52.

Figure 3:
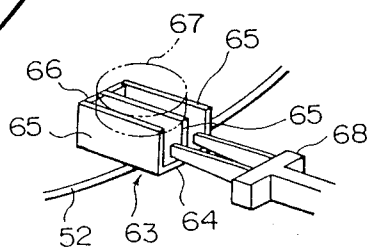
FIG. 3 is a perspective view partly showing only the relation between the work mount, the turntable, and the fork.

A plurality of work mounts 63 is attached on the upper surface of each of the lower turntable 41, the second and third upper turntables 52 and 53, along the outer edge portion thereof as shown in detail but partially in FIG. 3. Each of the work mounts 63 is constituted by a belt-like bottom plate portion 64, three side plate portions 65, and a rear plate portion 66. The bottom plate portion 64 extends from the outer edge portion of each of the turntables 41, 51 and 52 toward the central portion of the same. The three side plate portions 65 are provided on longitudinal opposite end portions of the bottom plate portion 64 and on a substantially central portion between the opposite end portions. The rear plate portion 66 is disposed so as to close the end portions of the side plate portions 65 at the central portion side of each of the turntables 41, 51 and 52. Each of the work mounts 63 supports a work 67 as shown by the two-dot chain line in FIG. 3 by the upper end edges of the three side plate portions 65. The three side plate portions 65 and the rear plate portion 66 have sufficient height to insert a fork 68 between the side plate portions 65 so as to mount the work 67 on the work mount 63 and so as to take-out the work 67 from the work mount 63.

The fork 68 is inserted into the furnace 11 from openings 71 and 72 led to the upper and lower furnace chambers 45 and 46 through the right and left walls 12 and 13 and through the inner circumferential wall 17. Caps 73 and 74 are attached on the openings 71 and 72 respectively. The caps 73 and 74 are provided so as to be made vertically slidable by guide members 75 and 76 respectively. The openings 71 and 72 are opened by moving the respective caps 73 and 74 upward so that the fork 68 can be inserted into the furnace 11. The vertical movement of the caps 73 and 74 may be performed by utilizing driving force of an electric motor (not shown) or the like or performed by hand.

Figure 2:
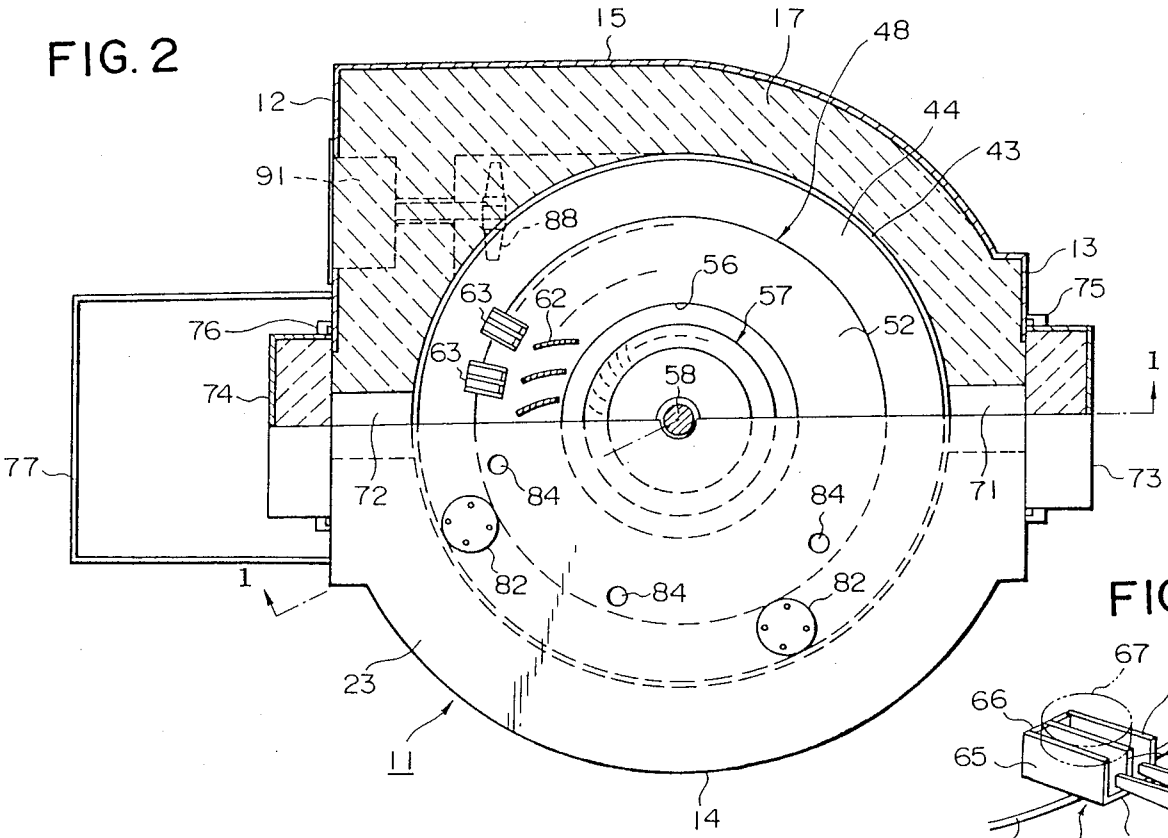
FIG. 2 is a plan view showing the same furnace, partly in section, at its upper half, along line 2—2 of FIG. 1.

An oil tank 77 for quenching the work 67 taken out from the work mount 63 of the lower turntable 41 in the lower furnace chamber 46 is provided on the furnace 11 at a side of the opening 72 as shown in FIG. 2. The oil tank 77 has a work throw-in portion (not shown) formed at a position substantially even to or lower than the lower end of the opening 72.

In the cap 24, a plurality of electric heaters for heating the inside of the upper furnace chamber 45 is provided at suitable intervals. In FIG. 1, only one electric heater 81 is representatively shown for the sake of simplicity of the drawings. More specifically, sleeves 83 are provided so as to communicate at their upper ends with insertion holes 82 formed through the upper wall 23 of the cap 24 and so as to open at their lower ends to the lower surface of the inner upper wall 25. The electric heaters 81 are respectively inserted through the sleeves 83 so that they are located in a gap between the outer circumferential edge of the upper turntable 48 and the inner circumferential surface of the inner circumferential wall 17. The lower ends of the respective electric heaters 81 are disposed in the vicinity of the third upper turntable 53. Further, in the cap 24, a plurality of carbon monoxide supply holes 84 for supplying carbon monoxide to be used for performing carburizing in the upper furnace chamber 45 is formed as shown by the chain lines in FIG. 1.

In the bottom wall 16, a plurality of electric heaters 85 similar to the electric heaters 81 is provided at suitable internals so as to be used for heating the inside of the lower furnace chamber 46. In FIG. 1, only one of the electric heaters 85 is representatively shown for the sake of simplicity of the drawing, similarly to the case of the electric heaters 85. Sleeves 87 are provided so as to communicate at their lower ends with insertion holes 86 formed through the bottom wall 16 and so as to open in the gap 21 at their upper ends. The electric heaters 85 are respectively inserted through the sleeves 87 so that they are located in the vicinity of the lower surface of the outer circumferential portion of the lower turntable 41 in the lower furnace chamber 46. Further, an axial fan 88 is provided in the gap 21 of the lower furnace chamber 46 so as to tangentially generate an air current. The axial fan 88 is attached on the front end of a substantially horizontally disposed rotary shaft 89 which is driven to rotate by an electric motor 91 attached on the inner circumferential wall 17 so as to be buried therein. In this embodiment, since the axial fan 88 is disposed so that the blades thereof project into the upper outer circumferential surface 19 of the inner bottom wall 18 as shown in FIG. 1, the inner bottom wall 18 is partially cut off so that the axial fan 88 can freely rotates. A supporting disc 92 having at its central portion an opening for passing the outer shaft 37 therethrough is fixed by bolts on the central opening of the upper plate 34 attached on the cylindrical member 33 inserted in the recess 32 of the inner bottom wall 18. A water jacket 93 is attached on the upper surface of the supporting disc 92 so as to surround the outer circumferential portion of the outer shaft 37 so that the outer and inner shafts 37 and 38 are cooled by water. A thrust bearing 94 for receiving external force axially acting as the outer shaft 37 rotates is attached on the lower surface of the supporting disc 92.

The outer shaft 37 is supported by the thrust bearing 94 so that the lower end of the outer shaft 37 is located at a position above the base 28 with a given interval from the base 28, and the outer shaft gear 95 is attached on the lower end of the outer shaft 37. The inner shaft 38 is rotatably supported on the base 28 by means of a bearing 96. A bearing 98 constituted by a ball bearing or the like is attached on a fitting portion between the outer and inner shafts 37 and 38 at a suitable interval so that the outer and inner shafts 37 and 38 are rotatable independently of each other. The outer shaft gear 95 and the inner shaft gear 97 are driven by sets of stepping motors and reduction gear trains (both not shown) provided separately from each other so that they are rotated by predetermined quantities of angle as the stepping motors make one revolution. Therefore, it is possible to detect the respective rotational states of the outer and inner shaft gears 95 and 97, that is, the respective rotational states of the lower and upper turntables 41 and 48 on the basis of the number of revolutions of the stepping motors.

Assume that carburizing treatment is performed in the upper furnace chamber 45 of the furnace 11 arranged as described above and diffusion treatment is performed in the lower furnace chamber 46 of the same. To this end, the temperatures in the upper and lower furnace chambers 45 and 46 are held to be about 950°C. and 850°C. respectively. This is realized by controlling the ON/OFF operation for the current supply to the electric heaters 81 and 85 and by rotating the silocco fan 57 and the axial fan 88 at predetermined rotational speeds so as to make the atmospheric temperatures int he upper and lower furnace chambers 45 and 46 uniform. While adjusting the atmospheric temperatures in the upper and lower furnace chambers 45 and 46 as described above, the cap 73 is opened and the work 67 is mounted, for example, on the work mount 63 on the second upper turntable 52 of the upper turntable 48 by the fork 68. At this time, the inner shaft 38 is rotated to thereby rotate the upper turntable 48 so that works 67 can be mounted successively one by one on the work mounts 63. When a predetermined number of works 67 have been mounted on the work mounts 63 on the second upper turntable 52, the cap 73 is closed. Then, the stepping motor (not shown) is driven. At this time, the stepping motor and gear train for driving the inner shaft 38 are set in advance so that in carburizing treatment the upper turntable 48 makes one revolution, for example, for 1.5 hours. Then, the upper furnace chamber 45 is maintained at the foregoing temperature of about 950°C., and carbon monoxide is supplied from the carbon monoxide supply hole 84 so that the upper furnace chamber 45 is held in a carbon monoxide atmosphere. In this state, the completion of one revolution of the upper turntable 48 is waited.

When the upper turntable 48 has made one revolution, the work 67 mounted on the work mount 63 of the second upper turntable 52 has been subject to carburizing treatment for 1.5 hours and has reached the position opposite to the opening 71 again. Here, the work 67 is displaced by the fork 68 from the work mount 63 on the second upper turntable 52 to the work mount 63 on the third upper turntable 53 disposed lower than the second upper turntable 52. Then, a new work 67 is supplemented on the empty work mount 63 on the second upper turntable 52. This operation is successively performed. When the work 67 mounted on the work mount 63 of the third upper turntable 53 has reached the position opposite to the opening 71 again, the work 67 has been subject to carburizing treatment for 3 hours. Then, the work 67 mounted on the work mount 63 on the third upper turntable 53 is displaced to the work mount 63 on the lower turntable 41 in the lower furnace chamber 46 by using the fork 68 in the same manner as described above.

At this time, the set of stepping motor and gear train for driving the outer shaft 37 are set in advance so that in diffusion treatment the lower turntable 41 makes one revolution, for example, for 1 hour. As a result, at the position opposite to the opening 71, the work 67 which has been subject to carburizing treatment is successively displaced from the upper turntable 53 to the lower turntable 41 so as to be treated thereon, and the work 67 which has been subject to carburizing treatment for a half of the necessary time on the second upper turntable 52 is successively displaced to the third upper turntable 53 so as to be treated thereon. Further, a new work 67 is successively mounted on the second upper turntable 52 so as to be treated thereon.

The work 67 displaced to the lower turntable 41 is subject to diffusion treatment in the lower furnace chamber 46. The work 67 which has been subject to diffusion treatment reaches the position opposite to the opening 72 after 0.5 hours. Here, the cap 74 is opened to a position where the lower end of the cap 74 comes near the shielding plate 43, and the fork 68 inserted into the lower furnace chamber 46 trough the opening 72. Then, the work 67 is lifted from the work mount 63 and taken out from the furnace 11. Next, the work 67 is drawn into oil in the oil tank 77 so as to be subject to quenching. The foregoing operation is successively performed every time a work 67 reaches the position opposite to the opening 72. As a result, a work 67 which is inserted into the furnace 11 is subject to carburizing treatment at 950°C. for 3 hours in the upper furnace chamber 45, subject to diffusion treatment at 850°C. for 30 minutes in the lower furnace chamber 46, and then subject to quenching as described above. In quenching in the oil tank 77, since only the work 67 is drawn into oil, a small quantity of oil suffices quenching and a cooling apparatus (not shown) for the oil tank 77 can be made small in size.

In the foregoing heat treatment, the time for the carburizing treatment time and the time for the diffusion treatment time are freely set in accordance with the material and the atmosphere in the furnace. The values of the atmospheric temperature and the treatment time illustrated in this embodiment are shown only by way of example. Further, in order to control the atmospheric temperatures in the upper and lower furnace chambers 45 and 46, a suitable number of thermocouples may be provided in the upper and lower furnace chambers 45 and 46 so that accurate temperatures in the upper and lower furnace chambers 45 and 46 are detected by averaging the detected values of the thermocouples.

Further description will be made as to the foregoing carburizing treatment. It is necessary that the carbon potential of a gas in the furnace is set to be somewhat high in the carburizing and carbo-nitriding zone in the upper furnace chamber 45, while it is set to be lower in the diffusion zone of the lower furnace chamber 46 than that of the upper furnace chamber 45. Therefore, it is preferable to form a partition between the zones as perfectly as possible. Then, in the second embodiment of the present invention illustrated in FIG. 4, an example of the partition arrangement between the upper and lower furnace chambers is illustrated.

Figure 4:
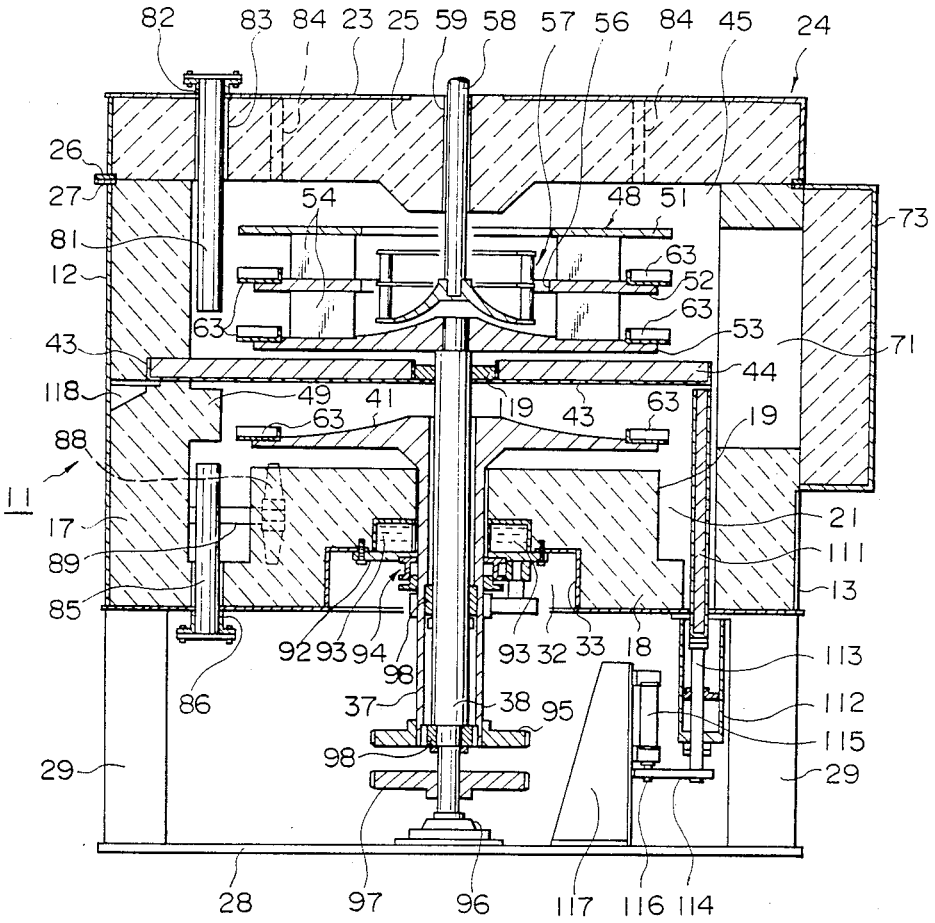
FIG. 4 is a longitudinally sectional side view showing another embodiment of the furnace according to the present invention in the state similar to that of FIG. 1.

That is, in the second embodiment, a shutter 111 for opening/closing the opening 71 of the lower furnace chamber 46 is provided at a position corresponding to the opening 71. The shutter 111 is disposed in a gap between the upper outer circumferential surface of the inner bottom wall 18 and the inner surface of the inner circumferential wall 17 so as to vertically extend through the inner bottom wall 18 and the bottom wall 16. The upper end of a connection rod 113 vertically movably supported in a bearing 112 is attached on the lower end of the shutter 111. The front end of a horizontally-extending connection arm 114 is attached on the lower end of the connection rod 113. The rear end of the connection arm 114 is attached on a plunger 116 of an air, hydraulic, or motor-driven cylinder 115. The cylinder 115 is attached on the base 28 by supporting member 117 so as to substantially vertically move the plunger 116. The shutter 111 has a length sufficient to cause the upper end of the shutter 111 to come into contact with the lower surface of the shielding plate 43 when the plunger 116 is pulled to its maximum into the cylinder 115 as shown in FIG. 4.

Further, in this embodiment, in order to make the isolation between the upper and lower furnace chamber 45 and 46 surer, the end edge portion of the partition constituted by the shielding plate 43 and the heat insulating material 44 is inserted into the inner circumferential wall 17 so as to be supported thereby. More specifically, the end edge portion of the partition constituted by the shielding plate 43 and the heat insulating material 44 except the portion of the partition contacting with the openings 71 and 72 is buried in the inner circumferential wall 17 and supported by brackets 118 provided on the left and right walls 12 and 13 and the front and rear walls 14 and 15. Further, an airtight bearing 119 is provided between the central opening 47 of the shielding plate 43 and the inner shaft 38.

When the lower furnace chamber 46 is to be closed, the shutter 111 is moved upward by the cylinder 115 so that the upper end of the shutter 111 comes into contact with the rear surface of the shielding plate 43. As a result, the lower furnace chamber 46 is separated from the upper furnace chamber 45 by the shielding plate 43 and the shutter 111. The isolation between the upper and lower furnace chambers 45 and 46 is made surer by providing a shutter mechanism similar to the shutter 111 also at the opening 72 side. In carryingin/out of a work 67, the shutter 111 may be moved down to a predetermined height by the cylinder 115.

In this structure, the isolation between the upper and lower furnace chambers 45 and 46 can be made surer. According to circumstances, however, in view of gas saving, the arrangement may be made so that a used gas in the diffusion zone is caused to flow into the carburizing zone and, for example, raw propane or butane is added to the used gas so as to cause chemical reaction $CO_2 + C \rightarrow 2CO$ to thereby utilize the used gas again as a carburizing gas.

Further, although not shown in the drawing, a shutter mechanism similar to that described above is provided in the upper furnace chamber 45 so as to close the upper furnace chamber 45.

Although description has been made as to the case where the furnace according to the present invention is used as a heat-treatment furnace in the foregoing embodiments, the furnace may be used, for example, in the following cases.

That is, the furnace according to the present invention may be used in the case where the furnace is used as a heat treatment furnace in which one of the furnace chambers is used for performing hot or warm forging and the other furnace chamber is used for performing normalizing, annealing, or the like, and in the case where one of the furnace chambers is used for sintering for powder metallurgy and the other furnace chamber is used for hardening or annealing of the sintered products. Further, the furnace according to the present invention may be used in the case where one of the furnace chambers is used for forging aluminum alloys or any other nonferrous alloys and the other furnace chamber is used for performing treatment for making the forged alloys solution, in the case where one of the furnace chambers is used for performing treatment for making forged alloys solution and the other furnace chamber is used for performing age-hardening treatment, and in the case where both the furnace chambers are used perform forging when forging is repeated plural times.

Although the inside of the furnace is divided into two furnace chambers in the foregoing first and second embodiments, the invention is not limited to these specific embodiments and the inside of the furnace ay be divided into two or more furnace chambers which can be controlled in different thermal atmosphere, if necessary.

Although the present invention has been described with reference to the preferred embodiments, the description has been made so as to understand the present invention. Therefore, it should be understood that various modifications to the preferred embodiments can be made without departing from the scope of the present invention as defined by the appended claims.

What is claimed is:

1. A furnace for applying heat treatment for works, comprising, a furnace wall for forming a casing of the furnace and having at least one opening, a partition horizontally situated inside the furnace wall for vertically dividing the furnace into at least first and second furnace chambers, a first turntable horizontally and rotationally situated inside the first furnace chamber, said first turntable supporting the works thereon, a second turntable horizontally and rotationally situated inside the second furnace chamber, said second turntable supporting the works thereon, means for rotating the first and second turntables, said rotating means being connected to the first and second turntables to independently rotate the same at predetermined speed, means for transferring works onto and from the first and second turntables through the opening of the furnace wall, first heating means situated inside the first furnace chamber to keep temperature inside the first furnace chamber at predetermined temperature, and second heating means situated inside the second furnace chamber to keep temperature inside the second furnace chamber at predetermined temperature.

2. A furnace according to claim 1, wherein said second turntable includes supporting members situated on the second turntable, said supporting members supporting the partition thereon so that the partition is situated above the second turntable at a predetermined distance away therefrom and is rotated together with the second turntable.

3. A furnace according to claim 1, wherein said partition includes an outer periphery fixed to the furnace wall.

4. A furnace according to claim 1, wherein said means for rotating the first and second turntables includes a first rotary shaft and a hollow second rotary shaft situated outside the first rotary shaft, said first turntable being attached to an upper end of the first rotary shaft and said second turntable being attached to an upper end of the second rotary shaft.

5. A furnace according to claim 1, wherein said first turntable includes a plurality of work supporting members arranged vertically away from each other, said work supporting members supporting the works on outer peripheral portions thereof.

6. A furnace according to claim 1, wherein said first turntable includes a central opening, said furnace further including blower means situated in the central opening of the first turntable to circulate fluid inside the first furnace chamber.

7. A furnace according to claim 6, wherein said first turntable further includes diffuser blade members situated outside the blower means for outwardly diffusing fluid sent by the blower means.

8. A furnace according to claim 1, further comprising a shutter attached to the opening of the furnace wall to open and close the same to communicate with at least one of the first and second furnace chambers.

9. A furnace according to claim 8, further comprising power means attached to the shutter for opening and closing the same.

10. A furnace for applying heat treatment for works, comprising, a furnace wall for forming a casing of a furnace, said furnace wall having at least one opening and an annular protrusion extending horizontally inwardly from the furnace wall, a partition horizontally situated inside the furnace wall for vertically dividing the furnace into at least first and second furnace chambers, said partition having an outer peripheral portion located above the annular protrusion, a first turntable horizontally and rotationally situated inside the first furnace chamber, said first turntable supporting the works thereon, a second turntable horizontally and rotationally situated inside the second furnace chamber, said second turntable supporting the works thereon, means for rotating the first and second turntables, said rotating means being connected to the first and second turntables to independently rotate the same at predetermined speed, means for transferring works onto and from the first and second turntables through the opening of the furnace wall, first heating means situated inside the first furnace chamber to keep temperature inside the first furnace chamber at predetermined temperature, and second heating means situated inside the second furnace chamber to keep temperature inside the second furnace chamber at predetermined temperature.

11. A furnace for applying heat treatment for works, comprising, a furnace wall for forming a casing of a furnace and having at least one opening, a partition horizontally situated inside the furnace wall for vertically dividing the furnace into at least first and second furnace chambers, a first turntable horizontally and rotationally situated inside the first furnace chamber, said first turntable supporting the works thereon, a second turntable horizontally and rotationally situated inside the second furnace chamber, said second turntable supporting the works thereon, blower means situated adjacent to the second turntable to send fluid in the tangential direction of the second turntable for circulation, means for rotating the first and second turntables, said rotating means being connected to the first and second turntables to independently rotate the same at predetermined speed, means for transferring works onto and from the first and second turntables through the opening of the furnace wall, first heating means situated inside the first furnace chamber to keep temperature inside the first furnace chamber at predetermined temperature, and second heating means situated inside the second furnace chamber to keep temperature inside the second furnace chamber at predetermined temperature.

12. A furnace according to claim 11, wherein said first turntable includes a central opening, said furnace further including blower means situated in the central opening of the first turntable to circulate fluid inside the first furnace chamber.

13. A furnace according to claim 11, wherein said furnace wall includes an annular recess adjacent the second furnace chamber, said blower means being situated in the annular recess.

* * * * *

UNITED STATES PATENT AND TRADEMARK OFFICE

CERTIFICATE OF CORRECTION

PATENT NO. : 4,986,750

DATED : January 22, 1991

INVENTOR(S) : Hidesato Sakamoto

It is certified that error appears in the above-identified patent and that said Letters Patent is hereby corrected as shown below:

Cover page, inventor's name, change "Hidasato Sakamoto" to --Hidesato Sakamoto--.

Signed and Sealed this

Second Day of June, 1992

*Attest:*

DOUGLAS B. COMER

*Attesting Officer*

*Acting Commissioner of Patents and Trademarks*